US005207328A

United States Patent [19]

Bose et al.

[11] Patent Number: 5,207,328

[45] Date of Patent: May 4, 1993

[54] THERMOPLASTIC BAG AND BAG PACK

[75] Inventors: Ajit K. Bose, Lawrenceville, N.J.; Daniel F. Hamman, LaGrange, Ga.; Paul L. Vest, Crestwood, Ky.

[73] Assignee: Union Camp Corporation, Princeton, N.J.

[21] Appl. No.: 812,612

[22] Filed: Dec. 23, 1991

[51] Int. Cl.[5] ..... B65D 33/14

[52] U.S. Cl. ..... 206/554; 383/8; 383/9; 383/37

[58] Field of Search ..... 383/8, 9, 37; 206/554

[56] References Cited

U.S. PATENT DOCUMENTS

| | | | |
|---|---|---|---|
| Re. 33,264 | 7/1990 | Baxley et al. . | |
| 4,165,832 | 8/1979 | Kuklies et al. . | |
| 4,476,979 | 10/1984 | Reimann et al. | 383/8 X |
| 4,529,090 | 7/1985 | Pilon | 383/8 X |
| 4,560,067 | 12/1985 | Reimann | 383/8 X |
| 4,676,378 | 6/1987 | Baxley et al. | 383/8 X |
| 4,759,639 | 7/1988 | DeMatteis . | |
| 4,785,938 | 11/1988 | Benoit et al. | 383/8 X |
| 4,796,759 | 1/1989 | Schisler | 383/8 X |
| 4,811,417 | 3/1989 | Prince et al. . | |
| 4,877,473 | 10/1989 | Snowdon et al. . | |
| 4,909,636 | 3/1990 | De Matteis et al. | 383/8 |
| 4,981,216 | 1/1991 | Wilfong | 383/8 X |
| 4,989,732 | 2/1991 | Smith | 383/9 X |
| 4,995,860 | 2/1991 | Wilfong et al. . | |
| 5,074,674 | 12/1991 | Kuklies et al. | 383/9 X |

*Primary Examiner*—Allan N. Shoap
*Assistant Examiner*—Jes F. Pascua
*Attorney, Agent, or Firm*—Pennie & Edmonds

[57] ABSTRACT

A bag and a bag pack consisting of a plurality of bags. Each bag has upstanding handles with apertures for mounting onto a bag loading rack. The cut formation of the apertures holds the handles of the bags together in the bag pack. The bag also has a center tab section for mounting on the bag loading rack. This tab section is permanently connected to the bag for removal with the bag when the latter is removed from the bag loading rack.

25 Claims, 4 Drawing Sheets

THERMOPLASTIC BAG AND BAG PACK

The present invention relates to a thermoplastic bag and more particularly to the type of bag which is commonly referred to as a T-shirt bag. Bags of this type are supplied to grocery stores in bag packs consisting of a plurality of stacked bags.

The individual bags include, front and back walls and handles extending upwardly from the front and back walls on either side of the bag to define a bag mouth between the handles. Typically, a tab member extends upwardly from the front and back walls in the mouth area and centrally on the handles.

A pack of bags is adapted to be mounted on a bag loading rack supplied at the checkout counter at the grocery store whereby individual bags can be pulled away from the pack by the checkout person for loading with groceries. Subsequent to loading, the loaded bag is removed from the rack.

For purposes of mounting a bag pack on the bag loading rack, mounting apertures are provided in the tab members and in the handles. The individual bags, however, are usually of very thin gauge thermoplastic material which is flimsy in nature. Therefore, it is necessary to provide some means of releasably holding together the handles of each bag in the bag pack to form a pair of handle stacks with the apertures of the handles aligned with each other. This facilitates initial mounting of the handle stacks onto the bag rack. In addition, the tab members of each bag are also provided with an aperture for mounting on the bag rack. As with the handles, it is necessary to maintain the apertures of the tab members in alignment so as to facilitate mounting onto the bag rack.

In the prior art, a number of bag structures and systems have been developed for accomplishing the above purposes. Typical of these are those disclosed in the following U.S. patents.

| U.S. Pat. No. | Inventor(s) |
|---|---|
| 4,165,832 | Kuklies et al |
| 4,476,979 | Reimann et al |
| 4,529,090 | Pilon |
| 4,759,639 | DeMatteis |
| 4,811,417 | Prince et al |
| 4,877,473 | Snowdon |
| 4,995,860 | Wilfong |
| Re. 33,264 | Baxley et al |

Generally, the bags and bag packs of the prior art as exemplified by the above patents have two things in common. First, the handle stacks are secured together independently of the cuts forming the handle apertures; and secondly, the tab members are permanently connected to each other for mounting on the bag rack and the bags are detachably connected to the tab members. These features of the prior art structures are disadvantageous in that they require additional manufacturing steps, thus adding to the costs of manufacture. Also, by separating each bag from its tab members, a plug of connected tab members is created. After the last bag has been removed from the bag rack, this, in turn, requires that the checkout person loading the next bag pack onto bag rack must first remove the plug of tab members and separately disposed of it.

SUMMARY OF THE INVENTION

In accordance with the teachings of the present invention, each bag of the bag pack is provided with an aperture in the handles which is constructed in the form of a uniquely shaped slit. This slit produces multiple sections of material which loosely interengage with each other to hold the layers of material of the handle together and to also hold the adjacent handles of each handle stack together in the bag pack. Thus, the apertures in the handle stacks formed by the slit are maintained in alignment for easy mounting on the bag rack. No separate manufacturing step or separate means need be provided for connecting the handles together in the handle stacks.

In addition, the detachable tab member of the prior art is eliminated with the present invention. Instead, the front and rear walls of the bag are each formed with a tab section which is permanently connected to the front and back walls and remains with the bag upon its removal from the bag loading rack. In order to mount the center part of the bag onto the bag rack between the mountings of the handle stacks, a mounting slit is cut through the front and back walls of the bag at the location of the tab sections. The slit is aligned in the front and back walls and also aligned with identical slits in all other bags of the bag pack. The slits are held in alignment in the individual bags and in the bag pack by releasably cold welding the tab sections together.

The spacing of the opposite ends of the mounting slits from the edges of the bag is such whereby pulling of the bag from its mounting on the bag rack will cause a tearing of the tab sections from the bag rack. At the same time a permanent connection of the tab sections to the front and back walls of the bag will be maintained at least at one of the ends of the slits. With this construction, the tab sections no longer remain on the bag rack. Thus, they no longer require separate removal from the bag rack prior to placing the next bag pack onto the rack and they no longer require separate disposal. Instead, they are disposed of with the bag itself.

DESCRIPTION OF THE PREFERRED EMBODIMENTS

Figure 1:
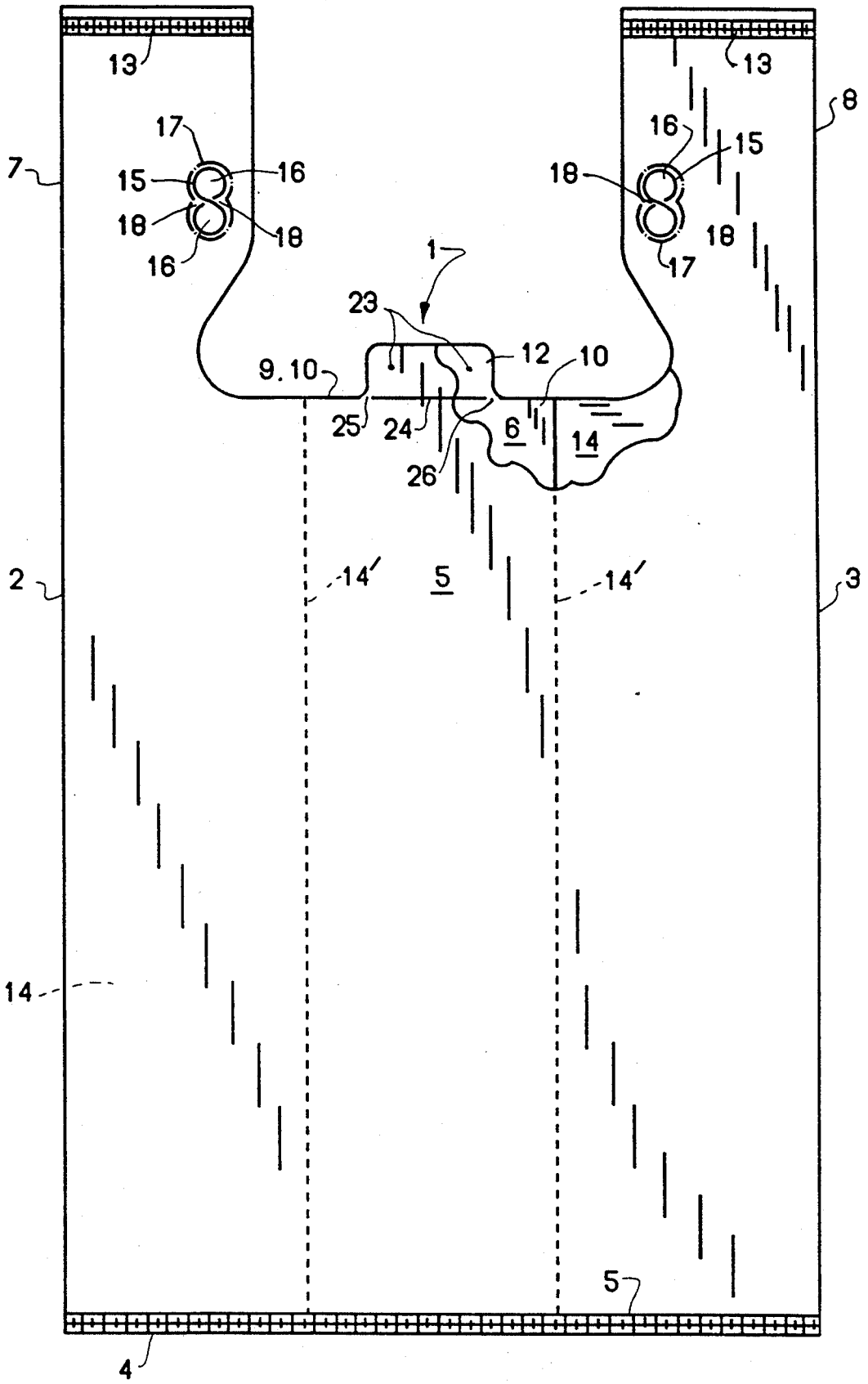
FIG. 1 is a front plan view of one embodiment of the bag of the present invention.

FIG. 1 shows a preferred first embodiment of the bag of the present invention. The bag is made of thermoplastic material such as high molecular weight, high density polyethylene. The bag is constructed from tubular thermoplastic material which is sealed and cut at spaced locations along the tube in a continuous manufacturing process to produce a plurality of bag blanks. These blanks are then stacked into a bag pack and a die apparatus is used to form the individual bags. As is shown in FIG. 1, the individual bag includes sides 2 and 3, a bottom 4 along which a seal line 5 is formed so that the bag is closed at its bottom by sealing together front and back walls 6 and 7. Handles 7 and 8 extend upwardly from the front and back walls on the opposite sides of the bag. These handles define an open mouth for the bag. The mouth is further defined by upper edges 9 and 10 of the front and back walls, respectively, of the bag. Finally, the front and back walls of the bag each include a tab section 12 located between the handles and extending upwardly from the upper edges of each of the front and back walls. As shown, these tab sections are in overlying relation with respect to each other and their outer edges connect with the upper edges 9, 10 of the front and back walls.

Figure 4:
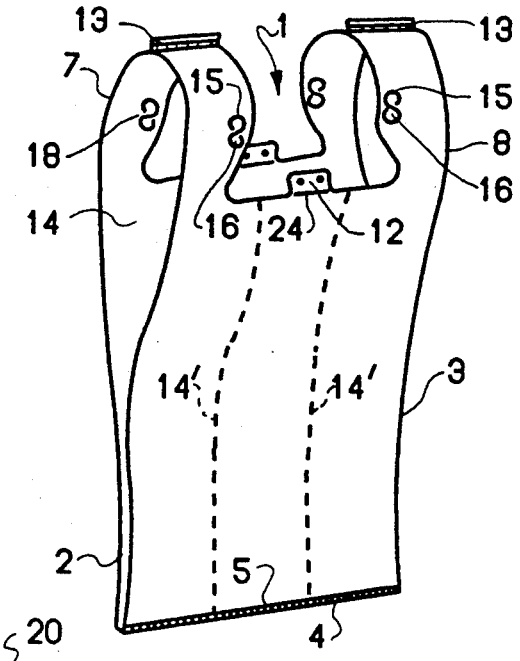
FIG. 4 is a perspective view of the bag of FIG. 1 shown in partially open condition.

In accordance with the present invention, each of the handles of the bag is comprised of multiple layers of material. Two layers of material are provided due to the fact that the handles are constructed from the front and back walls of the bag which are sealed together along seal lines 13 at the uppermost portions of the handles. In addition, the front and back walls of the bag are joined together at their sides 2 and 3 by folded pleats 14. These pleats extend upwardly at the sides of the bag and through the handles. This provides four layers of material for each of the handles. In FIG. 1 the inner fold lines of the pleats are shown at 14'. The pleat in its partially expanded state is shown in FIG. 4.

Each of the handles has an aperture extending through each layer of its material for mounting the bag on a bag rack. As shown in FIG. 1 the aperture is defined by an irregular shaped slit 15. The slit itself defines inner slit material 16 which is bounded by the slit 15. The slit also defines outer slit material 17. This outer slit material is the material of the layers of the handle which immediately surrounds the slit 15 and is shown in FIG. 1 by phantom lines. The inner slit material of each aperture is comprised of separate layers of material, the number of layers being equal to the number of layers of material from which the handle is formed. Each of these layers is integrally and flexibly connected to the outer slit material at the connection zones 18. This flexible connection permits loose interengagement of the layers of inner slit material with at least some of the other layers of both the inner and outer slit materials. The interengagement holds the layers of the handles together in a releasable fashion, as more fully discussed below.

In the preferred embodiment of the invention, the irregular shaped slit is an S-shaped slit. In order to increase the flexibility of the connection between the inner and outer slit materials and to thus increase the interengagement of these materials, the S-shaped slit is shaped with the opposite ends of the slit closely adjacent each other near the center of the S. This gives the S-shaped slit a further appearance of a figure eight.

The handles of the bag are wider at the top portion than at the lower portion. This defines an excess handle region extending laterally of the upper portion of each of the handles. The wider top portion of the handles of the bag makes it easier to carry the loaded bag. The S-shape slit is vertically oriented in the handles of the bag with the top of the S facing the top of each handle. The S-shaped slit is located in this excess handle region. The location of the S-shaped slits in the excess handle regions offsets these slits from the lines of strain on the handles when the loaded bag is lifted. This prevents the propagation of any tear in the area of the apertures when the handles are stressed during carrying of the loaded bag.

In the preferred embodiment of the invention, the slits 15 in the handles are formed without the removal of material. Thus, the inner and outer materials 16 and 17 defined by the slit are in effective engagement with each other. This, in turn, facilitates the interengagement of these materials. Further, as stated above, the bag material is a thermoplastic material. The thickness of the material is between about 0.55 and 0.75 mils. A gauge of 0.59 mils plus or minus 14% is preferred. This thinness of material and a static charge which is inherently present between the surface layers of material also facilitates the interengagement of the inner and outer slit materials in the handles. The static charge, which is usually undesirable, is used to advantage in the present invention. The charge tends to hold the adjacent layers of the slit materials together in surface to surface engagement.

Figure 5:
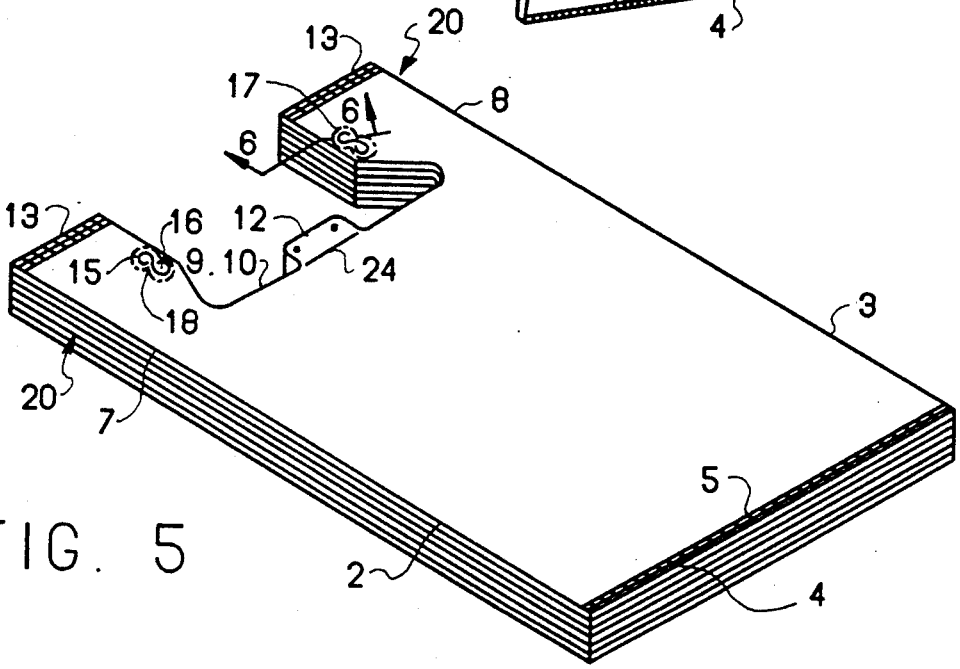
FIG. 5 is a perspective view of a bag pack of bags of the construction shown in FIG. 1.

FIG. 5 is a perspective view showing a bag pack comprised of a plurality of the stacked bags of the construction shown in FIG. 1. Typically, a bag pack will contain 50 individual bags. The bags are disposed in the bag pack with all parts thereof in overlying alignment. More particularly, the handles define a pair of handle stacks 20; and each slit 15 of each handle is aligned with the slit of every other handle in the stack.

Figure 6:
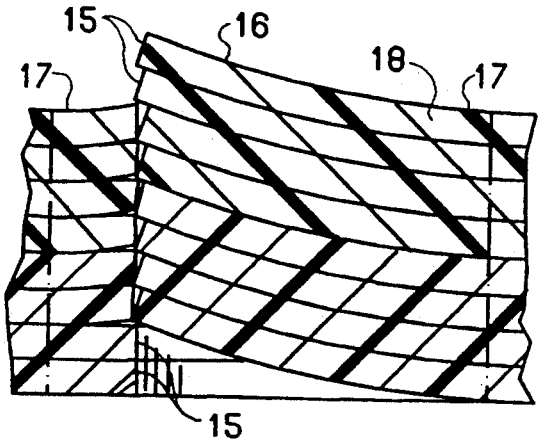
FIG. 6 is a cross-sectional view, on an enlarged scale, taken along lines 6—6 of FIG. 5.

Due to the configuration and physical characteristics of the slit materials in each handle as discussed above, the inner slit materials of a sufficient number of handles in each handle stack are adapted to interengage with slit material of adjacent handles. This interengagement will loosely hold the handles together in each of the handle stacks to an extent sufficient to permit handling of the bag pack and mounting of the handle stacks onto the bag loading rack. FIG. 6 shows a suitable interengagement of two adjacent bags in the bag pack as can exist after formation of the slits. The interengagement can be enhanced during the forming of the slits by simultaneously or subsequently manipulating the inner slit materials to affirmatively cause interengagement. This can be done, for example, by a suitable tool or pneumatically. The interengagement of the slit materials of the handles in each handle stack is the sole means for holding the handles together in the stacks.

The need for holding the handles of the handle stacks together is recognized by the prior art; but as indicated above, the prior art teaches the use of means separate from the apertures for effecting this. For example, U.S. Pat. Nos. 4,811,417, 4,877,473 and 4,995,860 disclose the use of cold welding of handles of the pack. U.S. Pat. Re. No. 33,264, on the other hand, discloses permanently hot welding together the inner flap material formed by the creation of the apertures in the handles. With the present invention, these extra manufacturing steps have been eliminated and the loose interengagement of the slit materials is solely relied upon for maintaining the handle stacks and the alignment of the slits 15.

The need for maintaining the handle stacks is most important during the handling of the bags by the grocery store checkout person. These packs of bags are delivered in a shipping carton containing a number of folded packs. The carton itself is constructed size-wise to maintain a tight fit about the enclosed bag racks so that during shipping there is little tendency for the bag packs to come apart.

Figure 7:
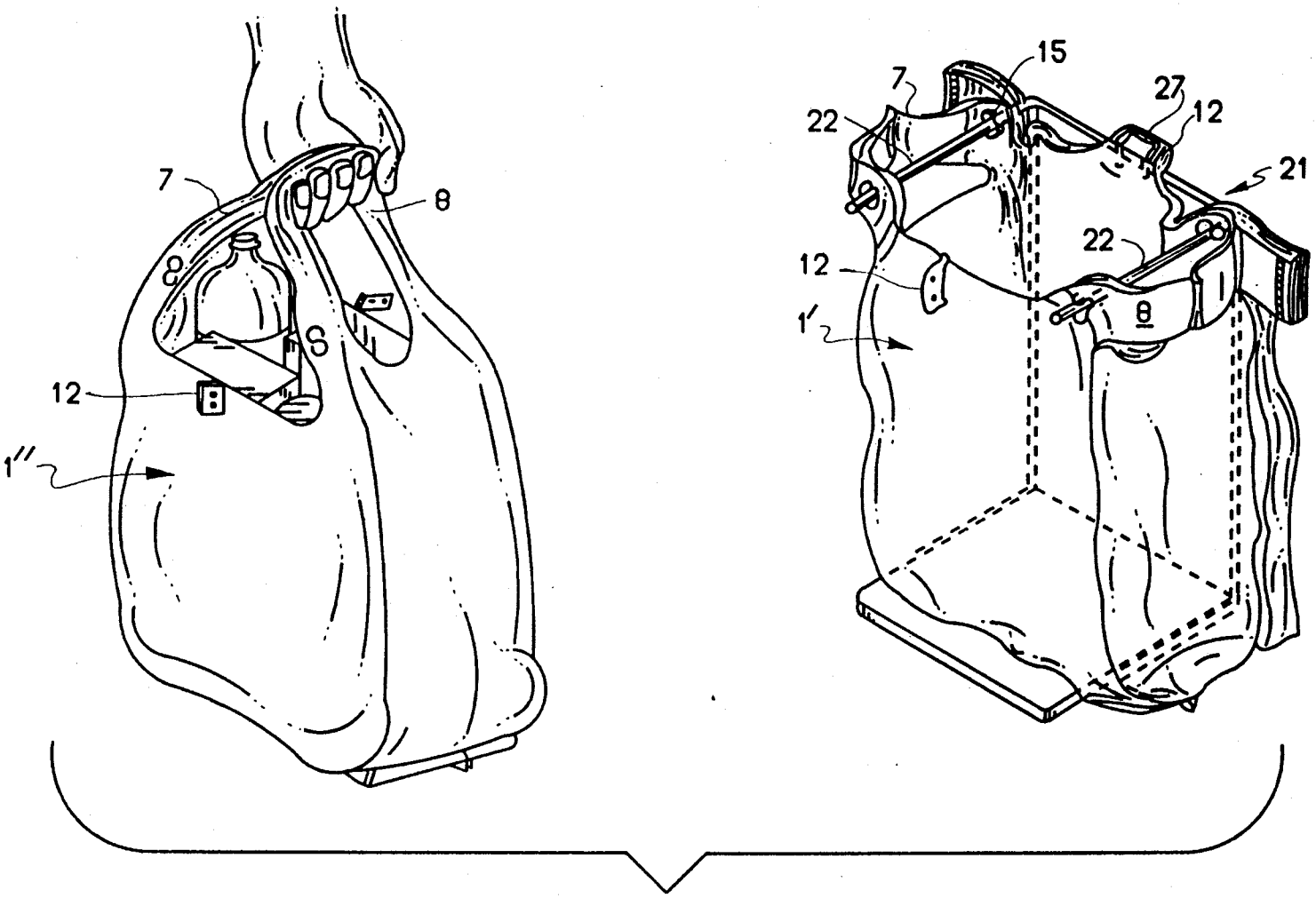
FIG. 7 is a perspective view of a bag pack mounted on a bag loading rack with one bag ready for loading and a previously filled bag removed from the bag rack.

As the checkout person removes a stack of bags from the shipping carton, the handles are grasped and placed on a bag loading rack, such as shown at 21 in FIG. 7, by inserting the horizontal arms 22 of the rack through the apertures formed by the slits 15. If during this handling, the individual handles in the handle stacks tend to shift with respect to each other, the inner slit materials of the layers of adjacent handles tend to loosely interengage with each other so as to prevent misalignment of the apertures. The static charge mentioned above also tends to hold the adjacent layers of slit material together.

After the bag pack has been mounted on the bag rack, the interengagement of the individual bags is easily broken as a bag is moved to a loading position. Such a bag is shown at 1' in FIG. 7. In this position, the front wall and handles which extend upwardly from the front wall have been separated from the back wall and handles of the individual bag 1'. Complete separation of the handles from the immediately adjacent bag in the bag pack is effected upon final removal of a loaded bag from the bag rack. Such a bag is shown in FIG. 7 at 1''.

The bag of FIG. 1 further includes means for center mounting the bags and bag pack onto the bag loading rack at the location of the tab sections. In addition, means are provided for releasably connecting together each of the tab sections of the bags of the bag pack to facilitate their center mounting on the bag rack. The connection of the tab sections is effected by cold welding them together as shown at 23. Any of the cold welding techniques disclosed in U.S. Pat. Nos. 4,811,417, 4,877,473 or 4,995,860 may be used for this purpose.

In accordance with the teachings of the present invention, the center mounting of the bags of the bag pack is accomplished by providing an opening in the form of a mounting slit 24 in each of the front and back walls of the bag at the location of the tab sections 12. The slits associated with each of the tab sections are themselves in overlying aligned relation with each other. Each mounting slit 24 defines a straight line of demarcation between the tab sections 12 and the front and back walls 9 and 10 of the bag. Also, the slits 24 are located in linear alignment with the upper edges 9, 10 of the front and back walls of the bag to define part of these upper edges.

The mounting slits 24 have opposite ends spaced from the upper edges 9 and 10 of the front and back walls to leave bridging regions 25, 26. As shown in FIG. 1 the spacing of the slits 24 with the upper edges of the front and back walls is greater at the bridging region 25 then at the other bridging region 26. With this construction, the bridging region 25 defines a permanent connection between the tab sections and the front and back walls of each bag.

When center mounting a bag pack 20 onto the bag loading rack 21, the overlying aligned mounting slits 24 of the bags in the bag pack are slipped over the rack mounting member 27, shown in FIG. 7. In the bag pack, the cold welding of the tab sections at 23 not only releasably connects the tab sections of a single bag together, but releasably connects the tab sections of adjacent bags of the pack together. In this way, maintaining the mounting slits aligned in the bag pack during handling is facilitated and the placement of the mounting slits 24 over the member 27 is easily effected.

When it is desired to move a bag of the bag pack to the bag loading position as shown by bag 1' in FIG. 7, the checkout person grabs the front wall 5 of the bag in the area of the mounting slit 24 and pulls it forward. This causes a tearing of the bridging region 26 in the front wall. As the front wall of the bag is pulled forward, the front tab section 12 attached to the front wall comes with it due to the permanent connection provided by the bridging region 25. Removal of the tab section 12 of the front wall from the other tab sections in the bag pack is permitted due to the releasable cold welding of the tab sections at 23.

After loading of the bag 1', it is then removed entirely from the bag loading rack by pulling of the bag and the handles off of the rack. This, in turn, causes a tearing of the bridging region 26 connecting the back tab section 12 to the back wall 6 of the bag. This tab section nevertheless remains connected to the back wall due to its permanent connection at 25. The completely removed bag 1'' of FIG. 7 is shown with both tab sections 12 attached.

In the preferred embodiment of the invention as shown in FIG. 1, the spacing between the end of each mounting slit at the bridging region 25 is between about 0.35 and 0.4 inches and preferably about 0.375 inches. The spacing of the other end of the mounting slit, at the bridging region 26, is between about 0.1 and 0.15 inches and preferably about 0.125 inches.

Figure 2:
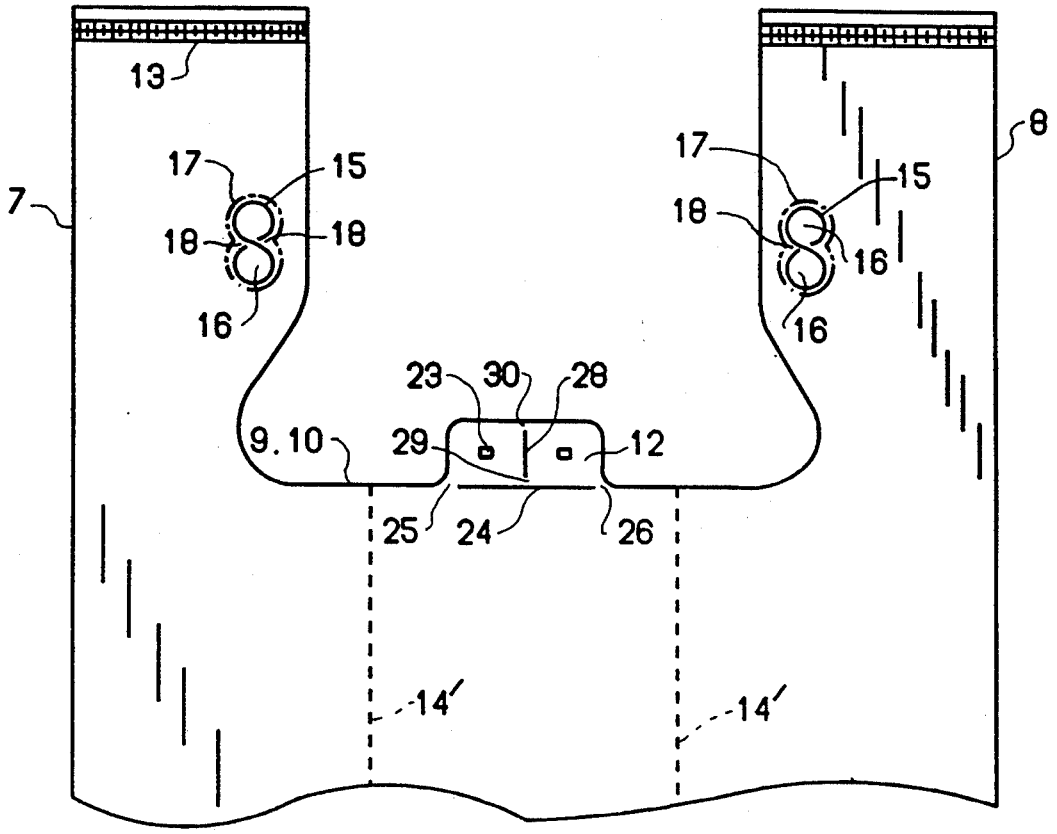
FIG. 2 is a front plan view of the upper portion of a second embodiment of the bag of the present invention.
Figure 3:
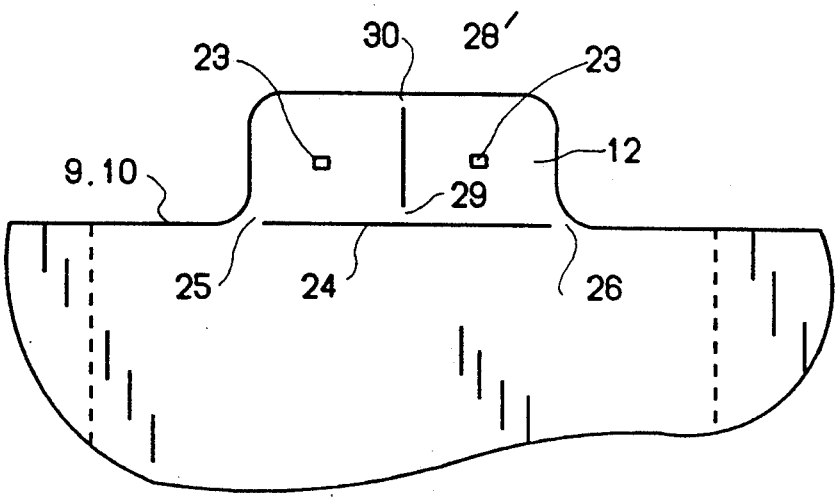
FIG. 3 is a partial front plan view of the upper portion of a third embodiment of the bag of the present invention.

FIGS. 2 and 3 show other embodiments of the bag of the present invention. In FIG. 2, the inner edge of each handle is different from that shown in FIG. 1. Instead of providing the curved transition between the lower and upper portions of the handle as in FIG. 1, the embodiment of FIG. 2 provides a straight line transition.

In addition, in FIG. 2, each tab section 12 is provided with a secondary slit 28 in each layer of the tab section of each bag. The secondary slits are in overlying alignment with each other. They also have opposite ends, one of which is closely spaced to the mounting slit 24 and the other of which is closely spaced to the upper edge of the tab section. The spacing defines tearable areas 29 and 30 for facilitating the removal of the individual bags from the mounting member 27 of the bag rack 21 while still maintaining the permanent connection at 25. The spacing at the tearable area 29 is nominally 0.05 inches while the spacing at the tearable area 30 is between about 0.1 and 0.15 inches and preferably about 0.125 inches. In the embodiment shown in FIG. 2, the secondary slits 28 extend substantially perpendicular to the mounting slits 24 and are centered on the tab sections. Thus, they are closer to the end of the slit 24 defining the bridging region 25.

In FIG. 3, the secondary slit 28' is shown as further shifted toward the bridging region 25. The slit 28' also extends substantially perpendicular to the slit 24. It has been found in the pulling of individual bags from the bag pack that the offset positioning of the secondary slit is particularly useful in facilitating easy removal of the individual bags from the support structure 27 of the bag loading rack.

The above description is of the presently preferred embodiments of the invention. It is to be understood, however, that various modifications can be made to these embodiments without departing from the scope of the invention as set forth in the following claims.

We claim:

1. In a bag of thermoplastic material having opposite sides, bottom, front wall, back wall, open mouth and handles extending upwardly from said front and back walls on the opposite sides to define said mouth therebetween, each of said handles being comprised of multiple layers of said material and having aligned apertures therethrough for removably mounting said bag on a bag loading rack, the improvement wherein:

each of said apertures is defined by an S-shaped slit with the opposite ends of the slit terminating immediately adjacent an intermediate section of the slit;

each of said slits defines a two-part inner slit material bounded by said slit and outer slit material surrounding said slit; and the two-part inner slit material is comprised of separate layers of material, the inner slit material of each layer being integrally and flexibly connected to the outer slit material of the same layer at two separate locations for loose interengagement with at least some of the other layers of said inner and outer slit materials.

2. The improvement as set forth in claim 1, wherein:

the front and back walls of the bag are joined together by folded pleats extending upwardly through said handles to provide four layers of material in each bag handle in which said slit is located.

3. The improvement as set forth in claim 2, wherein:

each handle is wider at a top portion thereof than at a lower portion thereof to define an excess handle region extending laterally of the upper portion of the handle; and said slit is located in the upper portion of the handle in said excess handle region.

4. In a bag pack comprised of a plurality of stacked bags of thermoplastic material, each bag having opposite sides, bottom, front wall, back wall, open mouth and handles extending upwardly from said front and back walls on the opposite sides to define said mouth therebetween, the handles defining a pair of handle stacks in the bag pack with each handle of each stack having an aperture aligned with an aperture in each other handle of the stack for removably mounting said bag pack on a bag loading rack, the improvement wherein:

each of said apertures is defined by a S-shaped slit with the opposite ends of the slit terminating immediately adjacent an intermediate section of the slit;

each of said slits defines a two-part inner slit material bounded by said slit and outer slit material surrounding said slit;

the two-part inner slit material of each handle is comprised of separate layers of material, the inner slit material of each layer being integrally and flexibly connected to said outer slit material of the same layer at two separate locations;

the inner slit material of each handle stack is positioned for loose interengagement with the slit material of adjacent handles for holding said handles together in said handle stack with said apertures thereof aligned; and the interengagement of said slit materials provides the sole means of holding said handles together in said handle stacks.

5. The improvement as set forth in claim 4, wherein:

each handle is wider at the top portion thereof than at a lower portion thereof to define an excess handle region extending laterally of the upper portion of the handle; and the slit is located in the upper portion of the handle in said excess handle region.

6. The improvement as set forth in claim 5, wherein:

the front and back walls of the bag are joined together by folded pleats extending upwardly through said handles to provide four layers of material in each bag handle in which said slit is located.

7. The improvement as set forth in any one of claims 1–6, wherein:

the S-shaped slit is vertically oriented with the top of the S facing the top portion of the handle.

8. The improvement as set forth in claim 7, wherein:

the S-shaped slit is shaped with opposite ends closely adjacent each other near the center of the S whereby the slit also has the appearance of a figure eight.

9. The improvement as set forth in claim 8, wherein:

the thermoplastic material has a gauge thickness of between about 0.55 and 0.75 mils.

10. In a bag of thermoplastic material having opposite sides, bottom, front wall, back wall, open mouth and handles extending upwardly from said front and back walls on the opposite sides of the bag to define said mouth therebetween, said mouth being further defined by an upper edge of the front and back walls extending between said handles; the improvement wherein:

said front and back walls each include a tab section located between said handles and extending upwardly from the upper edge of each of said front and back walls in overlying relation with respect to each other, each of said tab sections having an outer edge connected to the upper edge of the respective front and back walls;

a mounting slit in each of the front and back walls of the bag at the location of said tab sections;

each of said slits having opposite ends spaced from one of said outer edges to leave bridging regions therebetween, said bridging region at one end of said slits defining a permanent connection for each tab section to the respective wall on which each tab section is included, the bridging region at the other end of the slits defining a tear away zone for permitting removal of the entire bag from a bag loading rack when the bag is mounted thereon with rack structure extending through said mounting slit.

11. The improvement as set forth in claim 10, wherein:

said slits define a line of demarcation between said tab sections and said front and back walls.

12. The improvement as set forth in claim 11, wherein:

said slits are substantially straight and located in linear alignment with said upper edges of the front and back walls of the bag extending between the tab sections and said handles to define part of said upper edges.

13. In a bag of thermoplastic material having opposite sides, bottom, front wall, back wall, open mouth and handles extending upwardly from said front and back walls on the opposite sides of the bag to define said mouth therebetween, said mouth being further defined by an upper edge of the front and back walls extending between said handles; the improvement wherein:

said front and back walls each include a tab section located between said handles and extending upwardly from the upper edge of each of said front and back walls in overlying relation with respect to each other, each of said tab sections having an outer edge connected to the upper edge of the respective front and back walls;

a mounting slit in each of the front and back walls of the bag at the location of said tab sections;

each of said slits having opposite ends spaced from one of said outer edges to leave bridging regions therebetween, said bridging region, at least at one end of said slits, defining a permanent connection for each tab section, the respective wall on which each tab section is included, for permitting removal of the entire bag from a bag loading rack when the bag is mounted thereon with rack structure extending through said mounting slit;

said slits defining a line of demarcation between said tab section and said front and back walls;

said slits being substantially straight and located in linear alignment with said upper edges of the front and back walls of the bag extending between the tab sections and said handles to define part of said upper edges;

the spacing of the slits with the upper edges of said front and back walls being greater at one end of the slits than at the other, with the bridging region at the one end defining said permanent connection.

14. The improvement as set forth in claim 13, wherein:

the thermoplastic material has a gauge thickness of between about 0.55 and 0.75 mils.

the spacing at the one end is between about 0.35 and 0.4 inches; and the spacing at the other end is between about 0.1 and 0.15 inches.

15. The improvement as set forth in any one of claims 10–14, wherein:

a secondary slit is located in each of said tab sections in overlying alignment with each other, the secondary slits having opposite ends, one of which is closely spaced to said mounting slits and the other of which is closely spaced to the outer edge of the tab sections to define tearable areas therebetween for facilitating removal of the bag from a bag rack structure extending through said mounting slit while maintaining the permanent connection of the tab sections to said front and back walls.

16. The improvement as set forth in claim 15, wherein:

the secondary slits extend substantially perpendicular to said mounting slits and are located closer to the one end of the slits than to said other end.

17. In a bag pack comprised of a plurality of bags of thermoplastic material as set forth in any one of claims 10–14, the improvement wherein:

said bags are disposed in said bag pack with all parts thereof in overlying alignment;

connecting means are located in each of said tab sections for releasably connecting together the tab sections of each of said bags of said bag pack with the mounting slits in overlying alignment with each other for permitting mounting of the bag pack on a bag loading rack with rack structure extending through said mounting slits.

18. The improvement as set forth in claim 17, wherein:

a secondary slit is located in each of said tab sections in overlying alignment with each other, the secondary slits having opposite ends, one of which is closely spaced to said mounting slits and the other of which is closely spaced to the outer edge of the tab sections to define tearable areas therebetween for facilitating removal of the bag from said bag rack structure while maintaining the permanent connection of the tab sections to said front and back walls.

19. The improvement as set forth in claim 18, wherein:

the secondary slits extend substantially perpendicular to said mounting slits and are located closer to the one end of the slits than to said other end.

20. The improvement as set forth in any one of claims 10–14, wherein:

each of said handles is comprised of multiple layers of thermoplastic material and includes an aperture through each layer for removably mounting said bag on a bag loading rack;

the apertures through the layers of each handle are in overlying alignment with each other;

each of said apertures is defined by an S-shaped slit with the opposite ends of the slit terminating immediately adjacent an intermediate section of the slit;

each of said slits defines a two-part inner slit material bounded by said slit and outer slit material surrounding said slit; and the two-part inner slit material is comprised of separate layers of material, the inner slit material on each layer being integrally and flexibly connected to said outer slit material of the same layer at two separate locations for loose interengagement with at least some of the other layers of said inner and outer slit materials.

21. The improvement as set forth in claim 20, wherein:

the S-shaped slit is shaped with opposite ends closely adjacent each other near the center of the S whereby the slit also has the appearance of a figure eight.

22. The improvement as set forth in claim 21, wherein:

the thermoplastic material has a gauge thickness of between about 0.55 and 0.75 mils.

23. In a bag pack comprised of a plurality of bags of thermoplastic material as set forth in claim 20, the improvement wherein:

said bags are disposed in said bag pack with all parts thereof in overlying alignment;

connecting means are located in each of said tab sections for releasably connecting together the tab sections of each of said bags of said pack with the mounting slits in overlying alignment with each other for permitting mounting of the bag pack on a bag loading rack with rack structure extending through said mounting slits;

the inner slit material of each handle of each handle stack is positioned for loose interengagement with the slit material of adjacent handles for holding said handles together in said handle stack with said apertures thereof aligned; and the interengagement of said slit materials provides the sole means of holding said handles together in said handle stacks.

24. The improvement as set forth in claim 23, wherein:

the S-shaped slit is shaped with opposite ends closely adjacent each other near the center of the S whereby the slit also has the appearance of a figure eight.

25. The improvement as set forth in claim 24, wherein:

the thermoplastic material has a gauge thickness of between about 0.55 and 0.75 mils.

* * * * *